US007188742B2

(12) United States Patent
Skulnik

(10) Patent No.: US 7,188,742 B2
(45) Date of Patent: Mar. 13, 2007

(54) FIRE CODE-COMPATIBLE, HIGH LOAD BEARING-COMPATIBLE, AND USER AND STORED GOODS LOADING AND UNLOADING-SAFE STORAGE RACK SHELVING

(75) Inventor: Richard M. Skulnik, Saddle River, NJ (US)

(73) Assignee: Clear Deck Solutions, Saddle River, NJ (US)

( * ) Notice: Subject to any disclaimer, the term of this patent is extended or adjusted under 35 U.S.C. 154(b) by 229 days.

(21) Appl. No.: 10/970,084

(22) Filed: Oct. 21, 2004

(65) Prior Publication Data

US 2006/0086683 A1 Apr. 27, 2006

(51) Int. Cl.
*A47F 5/00* (2006.01)

(52) U.S. Cl. ..... 211/135

(58) Field of Classification Search ..... 211/135, 211/153; 108/157.1, 153.1, 144.11, 106
See application file for complete search history.

(56) References Cited

U.S. PATENT DOCUMENTS 3,298,531 A * 1/1967 Wilcke ..... 211/70.6
6,401,944 B1 * 6/2002 Kircher et al. ..... 211/134

* cited by examiner

*Primary Examiner*—Sarah Purol
(74) *Attorney, Agent, or Firm*—Charles E. Baxley

(57) ABSTRACT

An improved fire code-compatible and high load bearing-compatible storage rack shelving of the type having a plurality of apertures, each of which surrounded by a vertically-depending flange terminating in a free edge. The improvement includes the free edge of each vertically-depending flange being directed in a direction that avoids contact therewith from below, such as in a direction other than down, so as to be safe for users working, and stored goods being loaded and unloaded, directly therebelow. In an embodiment, the free edge of each vertically-depending flange is rolled in a direction away from an associated aperture. In another embodiment, the free edge of each vertically-depending flange is formed into a C-channel, in a direction away from an associated aperture. In still another embodiment, the free edge of each vertically-depending flange is formed into a box-channel, in a direction away from an associated aperture.

14 Claims, 4 Drawing Sheets

FIRE CODE-COMPATIBLE, HIGH LOAD BEARING-COMPATIBLE, AND USER AND STORED GOODS LOADING AND UNLOADING-SAFE STORAGE RACK SHELVING

BACKGROUND OF THE INVENTION

1. Field of the Invention

The present invention relates to fire code-compatible and high load bearing-compatible storage rack shelving, and more particularly, the present invention relates to fire code-compatible, high load bearing-compatible, and user and stored goods loading and unloading-safe storage rack shelving.

2. Description of the Prior Art

Decking or shelving used in industrial and commercial storage racks has to be designed and constructed to bear heavy loads without twisting or buckling. For example, shelving used in bulk storage applications must be able to support the weight of densely packed rows of boxes filled with goods. In such applications, a solid steel sheet deck would be an ideal choice for shelving because it has a high load-bearing capacity.

The design and construction of decking or shelving must comply, however, with the requirements of any fire codes applicable to the particular storage environment. Fire codes generally require that the surface area of each deck or shelf have a certain amount of open area, e.g., a number of holes distributed along the surface of the deck or shelf. Obviously, a solid steel sheet deck would not meet this "open area" requirement and therefore could not be used as storage rack shelving.

The "open area" requirement serves two primary objectives from the standpoint of fire safety and prevention. First, the open area of each deck or shelf allows a fire that has broken out to move vertically up the storage rack instead of spreading horizontally to other storage racks, as the fire would do if it had broken out beneath a solid steel sheet deck. It also allows heat generated by the fire to dissipate instead of building up within a semi-enclosed space, as would be the case in a storage space between two solid steel sheet decks. In short, the open area creates a flue space within a storage rack, thereby causing the fire to travel upward and to release heat in the process. This maximizes the effectiveness of the sprinkler system in containing the fire because it allows the fire to reach the sprinkler heads as quickly as possible without building up too much heat and intensity.

Second, the open area of each deck or shelf allows water from an overhead sprinkler system to flow downward in the event of a fire. As long as water runs freely through the individual decks or shelves, an overhead sprinkler system can adequately contain a fire breaking out at any shelving level and prevent it from spreading to other storage racks.

The amount of open area generally required by fire codes is fifty percent (50%) of the surface area. Lower percentages may be allowed, however, depending on the particular storage environment. As pointed out supra, a solid steel sheet deck does not have any open area and therefore would not meet this "fifty-percent" rule. Consequently, it should not be used in bulk storage applications even though it has a high load-bearing capacity.

The fifty-percent rule necessarily calls for a unique solution to the problem of providing structural strength to decking or shelving.

For example, a wire mesh deck, commonly used in industrial and commercial settings, meets the fifty-percent rule but it deforms boxes and products therein under heavy loads because it has no uniform loading support.

Moreover, a wire mesh deck tends to rip up bulk items, thereby damaging stored goods. Cardboard boxes, carpets, and upholstered goods are susceptible to damage from punctures and snags as they are loaded onto or off a wire mesh deck. A wire mesh deck also creates a safety risk because the wire ends along the so-called "waterfall" edge that hugs the support beam can bend up and cut a worker's stray finger or other body part.

They cannot be packed densely in shipping, and therefore the costs of shipping are higher than they otherwise could be.

A slatted wooden deck, particle board deck or plywood deck, also commonly used, has disadvantages of its own. Wood burns and smokes readily. In most rack situations wood needs steel supports to span a deck of the rack. It also warps and moves due to moisture. Obviously, wooden decks are not as strong as steel decks, and the individual slats may break or bend, thereby causing a failure in the structural integrity of the deck and a safety hazard for workers.

Another bulk storage solution is a roll formed "front to back bar." This solution consists of a roll formed C-channel with welded or formed end plates that attach to a step beam. This solution is very expensive from a manufacturing standpoint because it uses a lot of heavy gauge steel. Moreover, one still has to use wooden pallets because the solution itself does not provide a flat storage surface.

Recognizing the disadvantages inherent in wire mesh decks and wooden decks, and the need for decking or shelving that meets fire code requirements without sacrificing load-bearing capacity, others have experimented with alternative designs and constructions. Even though these innovations may be suitable for the specific individual purposes to which they address, they each differ in structure and/or operation and/or purpose from the present invention, in that they do not teach storage rack shelving that not only meets the fire code rule and can handle high load-bearing applications, but is also safe for employees loading and unloading boxes in the shelving and will also not cause pulls and snags and rip up bulk items, such as cardboard boxes, carpet rolls, and upholstered goods, etc. being load and unloaded in the shelving when the shelving is so used, thereby not damaging stored goods.

FOR EXAMPLE, U.S. Pat. No. 5,199,582 to Halstrick teaches storage rack shelving in which there are corrugated decks with channels below the top surface for guiding and confining sprinkler fluid. Evenly spaced along the channels are openings through which sprinkler fluid flows down to the next shelving level. The decks, however, each have an open area of less than one-half of 1% of the total deck area. This obviously would not meet the fifty-percent rule.

Indeed, Halstrick expressly teaches away from the use of open decking. Halstrick considers open decking to be undesirable because it allows hot air to flow upward and cause a chimney effect. Halstrick does not permit smoke and gas to flow upwardly.

Contrary to Halstrick and as explained supra, open decking actually works together with an overhead sprinkler system to contain a fire. Here is the chain of events that occur when a fire breaks out in a storage environment. The fire's natural tendency is to rise, seeking out additional oxygen. Smoke and hot air also rise. They thus find their way to the closest sprinkler head, which activates and releases a spray of water. The water falls downward, thereby containing the fire and protecting areas adjacent to where the fire started. The open decking also allows excess heat to dissipate more rapidly. This is important because a hotter fire will be more difficult for the sprinkler system to contain, as the water droplets vaporize before they make contact with the flames.

ANOTHER EXAMPLE, U.S. Pat. No. 3,986,462 to Heft teaches shelving units with circular holes uniformly spaced throughout the surface area to permit the passage of water. Each shelving unit derives its structural strength through the presence of side members depending from the longitudinal edges of the top portion. Each shelf in turn is made up of several shelving units placed side by side on the beams of the rack. One apparent disadvantage is that the shelving units must be precisely sized so that they interlock snugly with the rack beams.

Another disadvantage of Heft is that the units would be prohibitively expensive to manufacture because of the high cost of materials. The units would also be costly to ship and install. Additionally, the circular holes in the shelving units weaken the structure such that the design cannot bear heavy loads. The holes also turn the shelving units into cheese graters that can damage stored goods and injure people.

STILL ANOTHER EXAMPLE, U.S. Pat. No. 3,927,769 to Maslow et al. teaches a shelf made of a rectangular sheet of material having raised ribs to support items placed thereon and apertures to permit the flow of air or water. The ribs reinforce the shelf structure. It does not appear that this design would meet the fifty-percent rule generally required by fire codes today.

Despite alternative designs and constructions that have been proposed over the years, as exemplified by the above patents, wire mesh decks and wooden decks are still widely used in industrial and commercial storage racks. There have been few attempts to address the needs of industry for decking and shelving that meets the fifty-percent rule and yet provides the load-bearing capacity required in bulk storage applications. Such decking or shelving should also be nonflammable and suitable for mass production and shipping at minimal cost.

YET ANOTHER EXAMPLE, U.S. Pat. No. 6,401,944 to Kircher et al. appears to fulfill all of the above objectives. It appears to offer a solution to industry requirements of shelving having up to fifty-percent open area, thereby apparently meeting the fire code requirements and a structure designed to withstand maximum stress with minimum amount of deflection, thereby can apparently handle high load-bearing applications. A corrugated deck for use as decking or shelving in storage racks is provided.

The configuration of Kircher et al. can best be seen in FIGS. 1, 2, and 3A, which are, respectively, an exploded diagrammatic perspective view of a prior art storage rack with shelving, an enlarged diagrammatic perspective view of the area generally enclosed by the dotted curve identified by ARROW 2 in FIG. 1 of the prior art storage rack shelving shown in FIG. 1, and an enlarged diagrammatic cross sectional taken along LINE 3A—3A in FIG. 2, and as such, will be discussed with reference thereto.

As shown in FIG. 1, a storage rack 10 has a deck 12. As shown in FIG. 2, the deck 12 has a plurality of apertures 14 punched or formed into horizontal surface areas 16 thereof, according to a predetermined pattern. A shown in FIG. 3A, each aperture 14 is punched or formed such that a downwardly sloping, vertical flange 18 is created from surrounding material. The downwardly sloping, vertical flange 18 directs flow of liquid departing from the associated aperture 14 and reinforces structural integrity of the deck 12.

Kircher et al. appear to meet the fire code rule and can handle high load-bearing applications, however, Kircher et al. have the disadvantage in that each downwardly sloping, vertical flange 18 terminates in a vertically-disposed free edge 20 or an angled free edge which can cause injury to employees loading/unloading boxes onto/off of a directly below deck 12 and also can cause pulls and snags and rip up bulk items, such as cardboard boxes, carpet rolls, and upholstered goods, etc. being load/unloaded onto/off of the directly below deck 12 when the deck 12 is so used, thereby damaging stored goods.

Thus, there exists a need for storage rack shelving that not only meets the fire code rule and can handle high load-bearing applications, but is also safe for employees loading/unloading boxes onto/off of the shelving and will also not cause pulls and snags and rip up bulk items, such as cardboard boxes, carpet rolls, and upholstered goods, etc. being load/unloaded onto/off of the shelving when the shelving is so used, thereby not damaging stored goods.

SUMMARY OF THE INVENTION

ACCORDINGLY, AN OBJECT of the present invention is to provide fire code-compatible, high load bearing-compatible, and user and stored goods loading and unloading-safe storage rack shelving that avoids the disadvantages of the prior art.

ANOTHER OBJECT of the present invention is to provide fire code-compatible, high load bearing-compatible, and user and stored goods loading and unloading-safe storage rack shelving that is simple to use.

BRIEFLY STATED, STILL ANOTHER OBJECT of the present invention is to provide an improved fire code-compatible and high load bearing-compatible storage rack shelving of the type having a plurality of apertures, each of which surrounded by a vertically-depending flange terminating in a free edge. The improvement includes the free edge of each vertically-depending flange being directed in a direction that avoids contact therewith from below, such as in a direction other than down, so as to be safe for users working, and stored goods being loaded and unloaded, directly therebelow. In an embodiment, the free edge of each vertically-depending flange is rolled in a direction away from an associated aperture. In another embodiment, the free edge of each vertically-depending flange is formed into a C-channel, in a direction away from an associated aperture. In still another embodiment, the free edge of each vertically-depending flange is formed into a box-channel, in a direction away from an associated aperture.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

PRIOR ART

10 storage rack

12 deck

Figure 1:
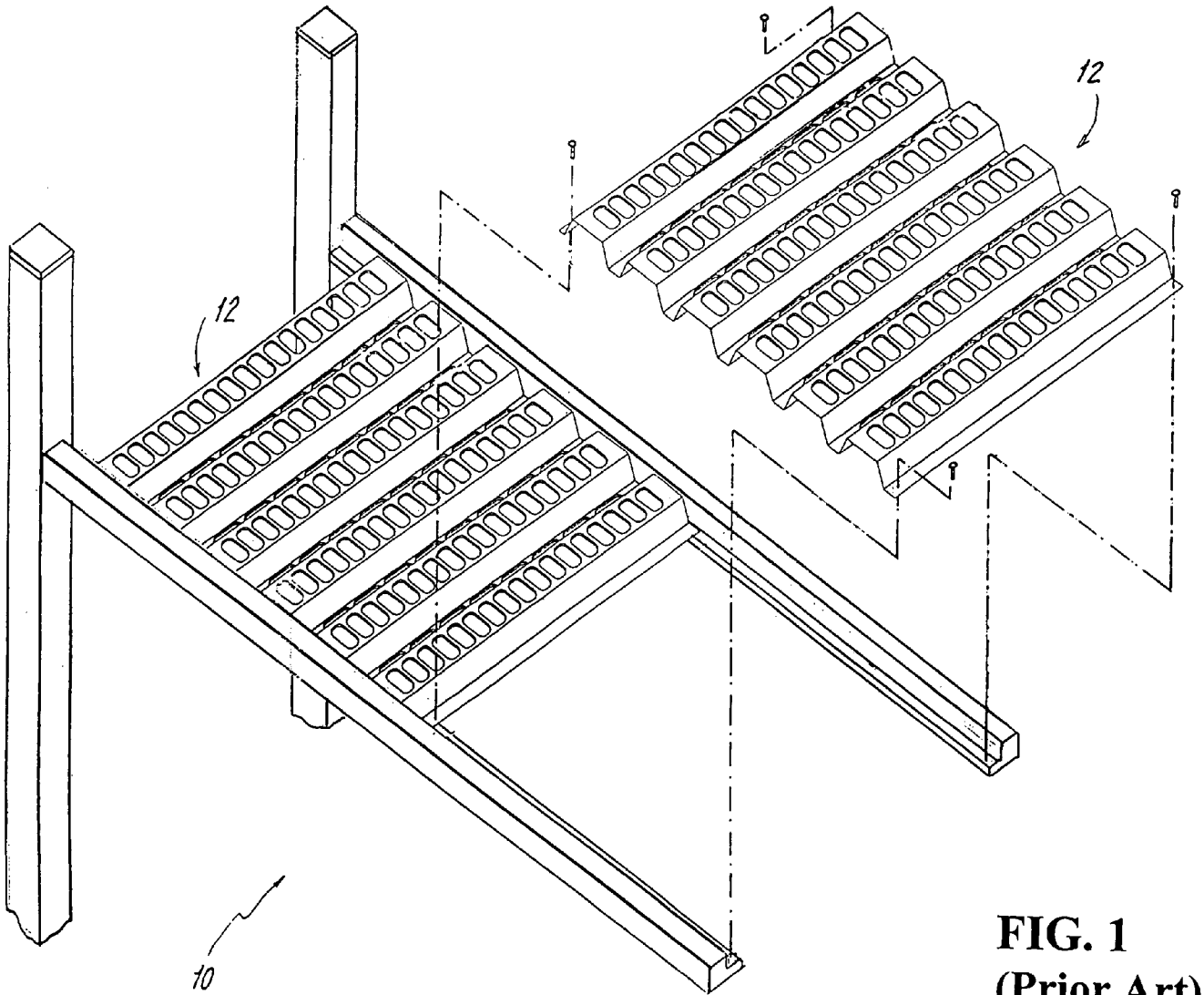
FIG. 1 (Prior Art)
FIG. 1 is an exploded diagrammatic perspective view of a prior art storage rack with shelving.
Figure 2:
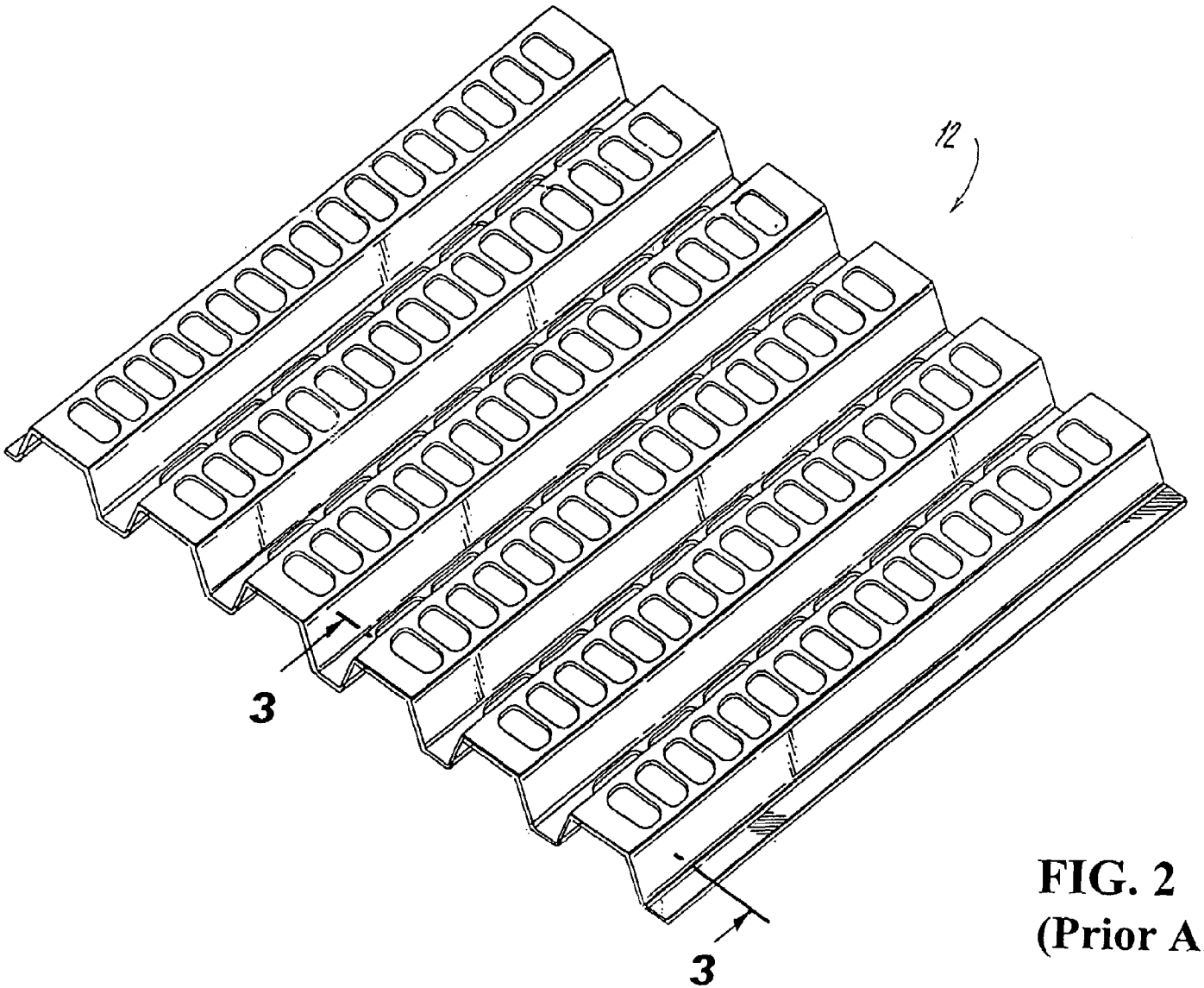
FIG. 2 (Prior Art)
FIG. 2 is an enlarged diagrammatic perspective view of the area generally enclosed by the dotted curve identified by ARROW 2 in FIG. 1 of the prior art storage rack shelving shown in FIG. 1.

14 plurality of apertures punched or formed into horizontal surface areas 16 of deck 12, according to predetermined pattern

16 horizontal surface areas of deck 12

18 downwardly sloping, vertical flange created from surrounding material of plurality of apertures 14 punched or formed into horizontal surface areas 16 of deck 12 for directing flow of liquid departing from aperture 14 and for reinforcing structural integrity of deck 12

20 vertically-disposed free edge of downwardly sloping, vertical flange of plurality of apertures 14 punched or formed into horizontal surface areas 16 of deck 12

Present Invention

First Embodiment

30 improved fire code-compatible, high load bearing-compatible, and user and stored goods loading and unloading-safe storage rack shelving of present invention to meet federal Occupational Health and Safety (OSHA) requirements.

32 free edge of each vertically-depending flange 18 of improved fire code-compatible, high load bearing-compatible, and user and stored goods loading and unloading-safe storage rack shelving 30

Second Embodiment

300 improved fire code-compatible, high load bearing-compatible, and user and stored goods loading and unloading-safe storage rack shelving of present invention

320 free edge of each vertically-depending flange 18 of improved fire code-compatible, high load bearing-compatible, and user and stored goods loading and unloading-safe storage rack shelving 300

330 C-channel formed from free edge 320 of each vertically-depending flange 18 of improved fire code-compatible, high load bearing-compatible, and user and stored goods loading and unloading-safe storage rack shelving 300

Third Embodiment

3000 improved fire code-compatible, high load bearing-compatible, and user and stored goods loading and unloading-safe storage rack shelving of present invention

3200 free edge of each vertically-depending flange 18 of improved fire code-compatible, high load bearing-compatible, and user and stored goods loading and unloading-safe storage rack shelving 3000

3300 box-channel formed from free edge 3200 of each vertically-depending flange 18 of improved fire code-compatible, high load bearing-compatible, and user and stored goods loading and unloading-safe storage rack shelving 3000

DETAILED DESCRIPTION OF THE PREFERRED EMBODIMENTS

Figure 3A:
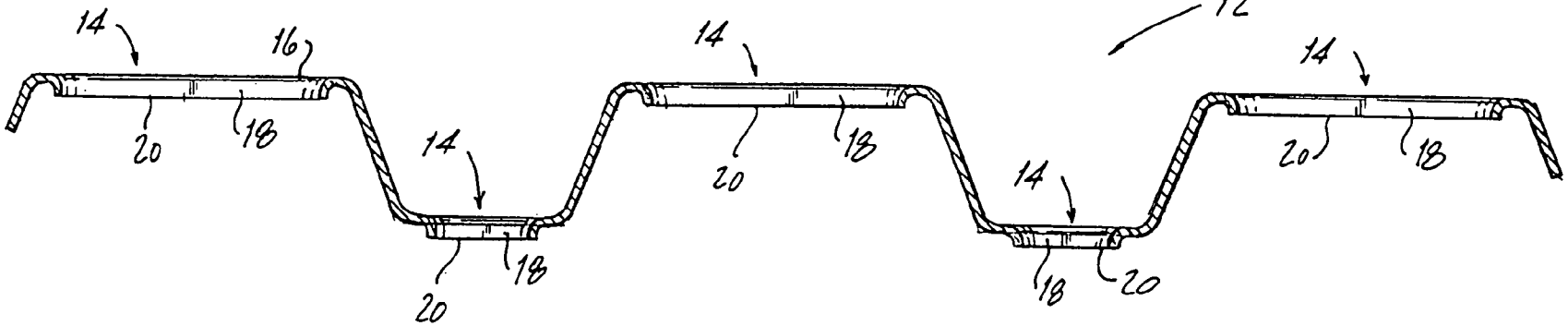
FIG. 3 A (Prior Art)
FIG. 3A is an enlarged diagrammatic cross sectional taken along LINE 3A—3A in FIG. 2.
Figure 3B:
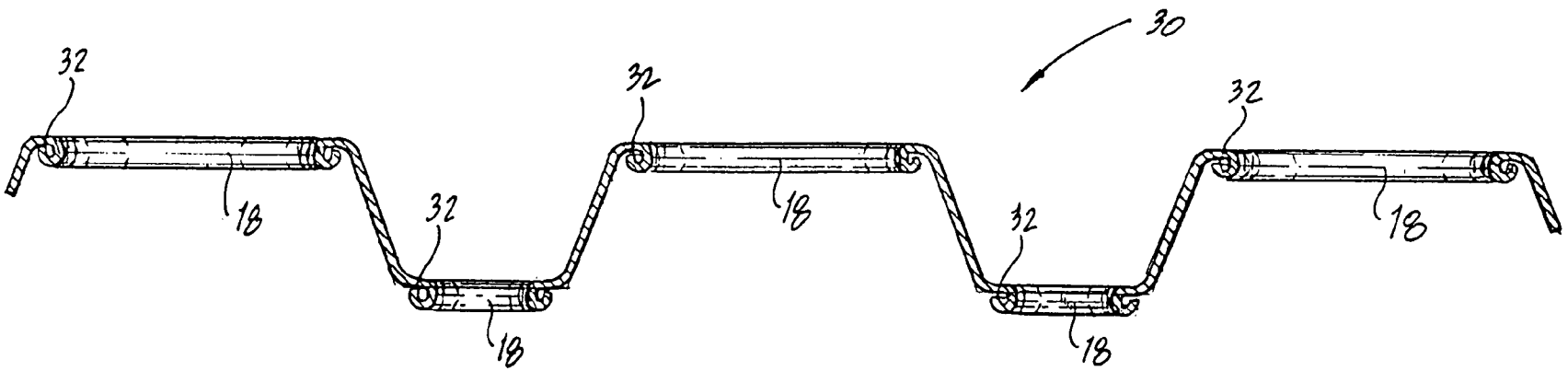
FIG. 3B is an enlarged diagrammatic cross sectional view of a first embodiment of the improved fire code-compatible, high load bearing-compatible, and user and stored goods loading and unloading-safe storage rack shelving of the present invention.
Figure 3C:
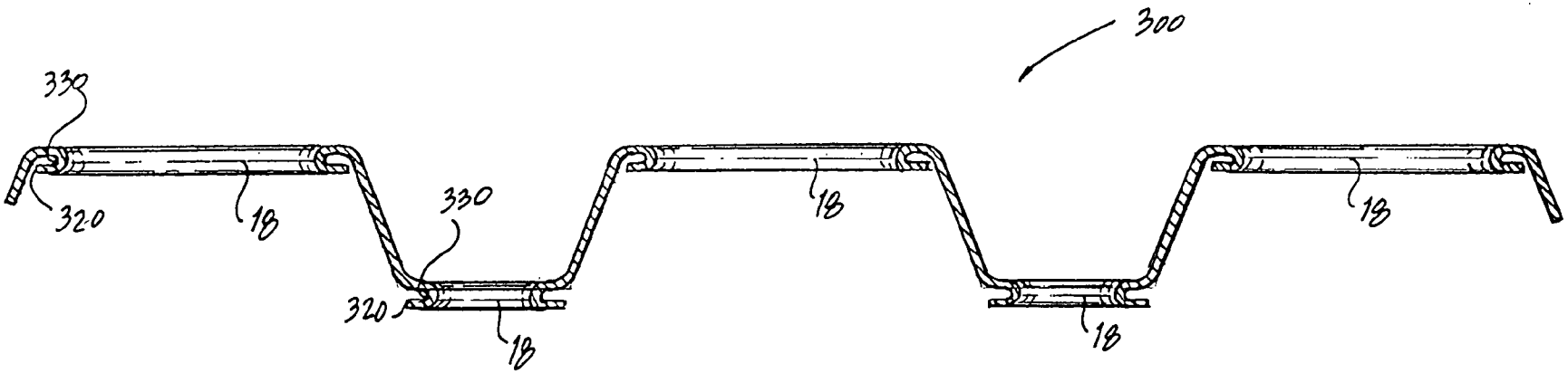
FIG. 3C is an enlarged diagrammatic cross sectional view of a second embodiment of the improved fire code-compatible, high load bearing-compatible, and user and stored goods loading and unloading-safe storage rack shelving of the present invention.
Figure 3D:
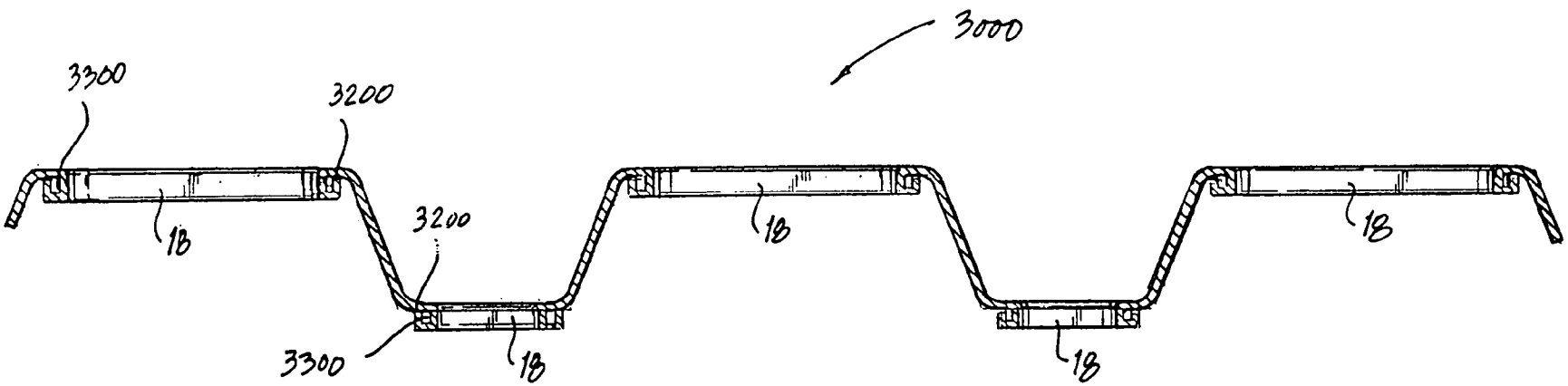
FIG. 3D is an enlarged diagrammatic cross sectional view of a third embodiment of the improved fire code-compatible, high load bearing-compatible, and user and stored goods loading and unloading-safe storage rack shelving of the present invention.

Referring now to the figures, in which like numerals indicate like parts, and particularly to FIGS. 3B–3D, which are, respectively, an enlarged diagrammatic cross sectional view of a first embodiment of the improved fire code-compatible, high load bearing-compatible, and user and stored goods loading and unloading-safe storage rack shelving of the present invention, an enlarged diagrammatic cross sectional view of a second embodiment of the improved fire code-compatible, high load bearing-compatible, and user and stored goods loading and unloading-safe storage rack shelving of the present invention, and an enlarged diagrammatic cross sectional view of a third embodiment of the improved fire code-compatible, high load bearing-compatible, and user and stored goods loading and unloading-safe storage rack shelving of the present invention, first, second, and third embodiments of the improved fire code-compatible, high load bearing-compatible, and user and stored goods loading and unloading-safe storage rack shelving of the present invention are shown generally at 30, 300, and 3000, respectively.

As shown generally in FIGS. 3B–3D, the free edge 32 of each vertically-depending flange 18 of the improved fire code-compatible, high load bearing-compatible, and user and stored goods loading and unloading-safe storage rack shelving 30, 300, 3000 is directed in a direction that avoids contact therewith from below and the damages associated therewith, such as other than down.

As shown specifically in FIG. 3B, the free edge 32 of each vertically-depending flange 18 of the improved fire code-compatible, high load bearing-compatible, and user and stored goods loading and unloading-safe storage rack shelving 30 is rolled in a direction away from an associated aperture 14.

As shown specifically in FIG. 3C, the free edge 32 of each vertically-depending flange 18 of the improved fire code-compatible, high load bearing-compatible, and user and stored goods loading and unloading-safe storage rack shelving 300 is formed into a C-channel 320, in a direction away from an associated aperture 14.

As shown specifically in FIG. 3D, the free edge 32 of each vertically-depending flange 18 of the improved fire code-compatible, high load bearing-compatible, and user and stored goods loading and unloading-safe storage rack shelving 3000 is formed into a box-channel 3200, in a direction away from an associated aperture 14.

It will be understood that each of the elements described above, or two or more together, may also find a useful application in other types of constructions differing from the types described above.

While the invention has been illustrated and described as embodied in fire code-compatible, high load bearing-compatible, and user and stored goods loading and unloading-safe storage rack shelving, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved fire code-compatible and high load bearing-compatible storage rack shelving of the type having a plurality of apertures, each of which surrounded by a vertically-depending flange terminating in a free edge, wherein said improvement comprises the free edge of each vertically-depending flange being directed in a direction other than down so as to avoid contact therewith from below and damages associated therewith.

2. The improved shelving as defined in claim 1, wherein said improvement comprises the free edge of each vertically-depending flange being rolled.

3. The improved shelving as defined in claim 1, wherein said improvement comprises the free edge of each vertically-depending flange being rolled in a direction away from an associated aperture.

4. The improved shelving as defined in claim 1, wherein said improvement comprises the free edge of each vertically-depending flange being formed into a C-channel.

5. The improved shelving as defined in claim 1, wherein said improvement comprises the free edge of each vertically-depending flange being formed into a C-channel, in a direction away from an associated aperture.

6. The improved shelving as defined in claim 1, wherein said improvement comprises the free edge of each vertically-depending flange being formed into a box-channel.

7. The improved shelving as defined in claim 1, wherein said improvement comprises the free edge of each vertically-depending flange being formed into a box-channel, in a direction away from an associated aperture.

8. A fire code-compatible, high load bearing-compatible, and user and stored goods loading and unloading-safe storage rack shelving, comprising a deck;

wherein said deck has a plurality of apertures;

wherein each aperture is surround by a vertically-depending flange;

wherein each vertically-depending flange terminates in a free edge; and wherein said free edge of each vertically-depending flange is directed in a direction other than down so as to avoid contact therewith from below and damages associated therewith.

9. The deck as defined in claim 8, wherein said free edge of each vertically-depending flange is rolled.

10. The deck as defined in claim 8, wherein said free edge of each vertically-depending flange is rolled in a direction away from an associated aperture.

11. The deck as defined in claim 8, wherein said free edge of each vertically-depending flange is formed into a C-channel.

12. The deck as defined in claim 8, wherein said free edge of each vertically-depending flange is formed into a C-channel, in a direction away from an associated aperture.

13. The deck as defined in claim 8, wherein said free edge of each vertically-depending flange is formed into a box-channel.

14. The deck as defined in claim 8, wherein said free edge of each vertically-depending flange is formed into a box-channel, in a direction away from an associated aperture.

* * * * *